US005823921A

United States Patent [19]

Dawson

[11] Patent Number: 5,823,921

[45] Date of Patent: Oct. 20, 1998

[54] FREEWEIGHT BARBELL LIFTING EXERCISE MACHINE WITH USER CONTROLLABLE LIFT ASSIST AND SAFETY DEVICE

[76] Inventor: Jeffrey S. Dawson, P.O. Box 544, Canton, Conn. 06019

[21] Appl. No.: 699,113

[22] Filed: Aug. 16, 1996

Related U.S. Application Data

[63] Continuation-in-part of Ser. No. 212,508, Mar. 11, 1994, abandoned.

[51] Int. Cl.[6] ..... A63B 21/078

[52] U.S. Cl. ..... 482/104; 482/93

[58] Field of Search ..... 482/94, 97, 98–99, 482/101–103, 104, 106, 112, 113, 93

[56] References Cited

U.S. PATENT DOCUMENTS

| | | | |
|---|---|---|---|
| 4,561,651 | 12/1985 | Hole | 482/104 |
| 4,998,721 | 3/1991 | Anders et al. | 482/104 |
| 5,190,510 | 3/1993 | Goodger | 482/104 |
| 5,310,394 | 5/1994 | Kallius | 482/104 |

FOREIGN PATENT DOCUMENTS

| | | | |
|---|---|---|---|
| 1233880 | 5/1986 | U.S.S.R. | 482/104 |

*Primary Examiner*—Richard J. Apley
*Assistant Examiner*—John Mulcahy
*Attorney, Agent, or Firm*—McCormick, Paulding & Huber

[57] ABSTRACT

A freeweight lifting exercise machine having a barbell connected to a cable system operated by a pneumatic motor supported below a lifting bench. An electropneumatic control system operated by a weightlifter using the machine controls the pneumatic motor to apply an exponentially variable lifting force to the cable in response to linear movement of a foot pedal to replicate the function of a "spotter". The control system automatically applies sufficient lifting force to the cable to remove slack from the cable during the lifting mode and nullifies the slack removing force during the lowering mode of a normal lifting exercise enabling the lifter to perform a freeweight lifting exercise free of machine influence.

35 Claims, 7 Drawing Sheets

FREEWEIGHT BARBELL LIFTING EXERCISE MACHINE WITH USER CONTROLLABLE LIFT ASSIST AND SAFETY DEVICE

This is a continuation-in-part of application Ser. No. 08/212,508 filed on Mar. 11, 1994, and now abandoned.

BACKGROUND OF THE INVENTION

The present invention relates to exercise equipment generally and more particularly to a freeweight barbell lifting exercise machine having a user controllable lift assisting mechanism to simulate and replicate the function of a spotter during the lifting of freeweight barbell assemblies.

It is generally recognized that freeweight barbell assemblies can be effectively utilized by a weightlifter in various exercise programs to increase both stamina and overall muscle strength, because the lifter must both balance and lift weights mounted on opposite end portions of a lifting bar thereby exercising the whole cross sectional area of muscle. One of the most common and effective weightlifting techniques to increase overall muscle strength requires the weightlifter to repetitively lift a predetermined weight until his or her muscles have reached a point of nearly complete exhaustion. However, because of the ever present possibility that the weightlifter may sustain serious physical injury during such weight lifting exercises, it is essential that proper safety procedures be followed.

It is a common safety practice for a weightlifter to engage the assistance of a spotter or lifting partner whose function it is to observe the weightlifter during his or her exercise program and to render assistance, as necessary, if the weightlifter loses control of a barbell assembly or, as the weightlifter approaches the point of failure, lift a greater percentage of the weight until the lifter reaches the failure point, i.e., the point at which he or she cannot lift additional weight. At this point, the weight is completely transferred from the lifter to the spotter who then places the lifting bar on a weight lifting rack.

The ideal spotter is one so familiar with the lifter that he or she knows not only how much to spot but also how much lifting assistance to provide during the course of an exercise and how rapidly to provide the required lifting assistance. From a practical standpoint, it is often inconvenient for a weightlifter to obtain the service of a spotter before commencing a repetitive weight lifting exercise and particularly when the weightlifter is working out at home or at another location where a spotter may not be readily available. The weightlifter may then either disregard proper safety procedure and carry out the proposed weightlifting exercises without the assistance of a spotter or otherwise abandon plans to carry out certain types of particularly dangerous exercise routines.

Some exercise machines as, for example, "Nautilus" or "Universal" machines do not require weight balancing during performance of an exercise and are designed to be used without a spotter. Such machines provide a degree of safety but unfortunately exercise only a small cross sectional area of muscle and do not provide the full benefits associated with lifting freeweights.

There are presently a number of freeweight barbell assembly exercise machines designed to provide some degree of safety for a weightlifter, however such machines are usually complex and may employ a computer or microcontroller to provide safety sensing and reaction when needed. The safety sensing and reaction of an exercise machine of the aforesaid type is, unlike that of a spotter, not smooth or sensitive and when activated provides a more "crane-like" response in removing the weight burden from the lifter. In addition, the cost of such freeweight barbell assembly exercise machines is usually relatively high, therefore, such machines have not gained general acceptance for either gymnasium or home use.

It is the general aim of the present invention to provide an improved user controlled freeweight lifting exercise machine which replicates the function of a spotter during a free weight lifting exercise and which enables a weightlifter to perform such an exercise with a relative degree of safety and without the assistance of a spotter. A further aim of the invention is to provide an improved machine of the aforedescribed type which enables a normal free weight lifting exercise to be performed substantially free of machine influence during both lifting and lowering exercise modes.

SUMMARY OF THE INVENTION

In accordance with the present invention a freeweight exercise machine is provided for use with a barbell having and axially elongated lifting bar and a plurality of weights carried by and mounted at opposite end portions of the bar. The machine comprises a frame assembly which includes a cable suspension frame having a pair of transversely spaced apart and upwardly extending cable suspension members. Each of the cable suspension members has a generally rearwardly extending cantilever upper end portion. The frame assembly further includes a bench support frame connected to a central portion of the cable suspension frame and extending in a longitudinally rearward direction from it. The bench support frame defines a generally horizontally disposed and upwardly facing bench support surface. A cable assembly supported for movement on and relative to the cable suspension frame has opposite end portions each of which depends from an associated one of the cantilever upper end portions. A means is provided for securing the opposite end portions of the cable assembly to axially spaced apart portions of the lifting bar of an associated barbell. A fluid motor mounted on the bench support frame below the bench support surface has a first part mounted in fixed position relative to the bench frame and a second part supported for reciprocal movement relative to the first part and generally toward and away from the cable suspension frame. The machine further includes connecting means for attaching the cable assembly to the motor for movement with and relative to the second part, and motor control means including a manually operable control member for operating the motor to apply lifting force to the barbell assembly and to vary the magnitude of the applied lifting force.

DETAILED DESCRIPTION OF PREFERRED EMBODIMENTS

Figure 1:
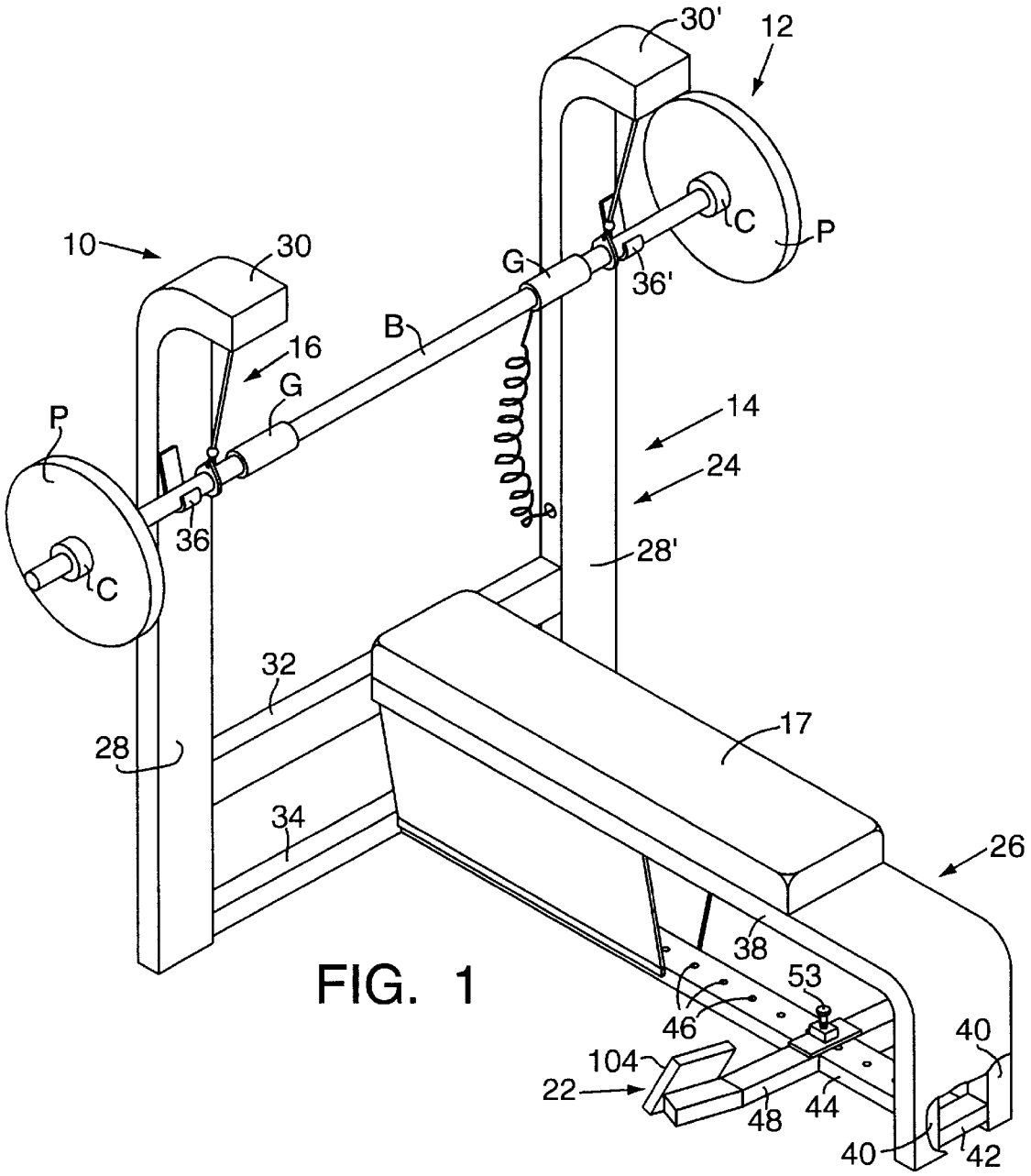
FIG. 1 is a perspective view of a freeweight exercise machine embodying the present invention and shown with a barbell assembly attached thereto.

Turning now to the drawings, a freeweight exercise machine embodying the present invention is shown in FIG. 1 and indicated generally by the reference numeral 10. The illustrated machine 10 resembles a bench press apparatus and is particularly adapted for use with a barbell assembly. A typical barbell assembly used with the machine 10 is shown at rest in FIG. 1 and designated generally by the reference numeral 12. The barbell assembly 12 includes a lifting bar B which has hand grips indicated at G, G. A plurality of weights or plates P, P (two shown) are mounted on opposite end portions of the lifting bar B in balanced relation to a central portion of the bar. The plates are releasably retained on the bar by conventional inside and outside collars C,C.

Figure 2:
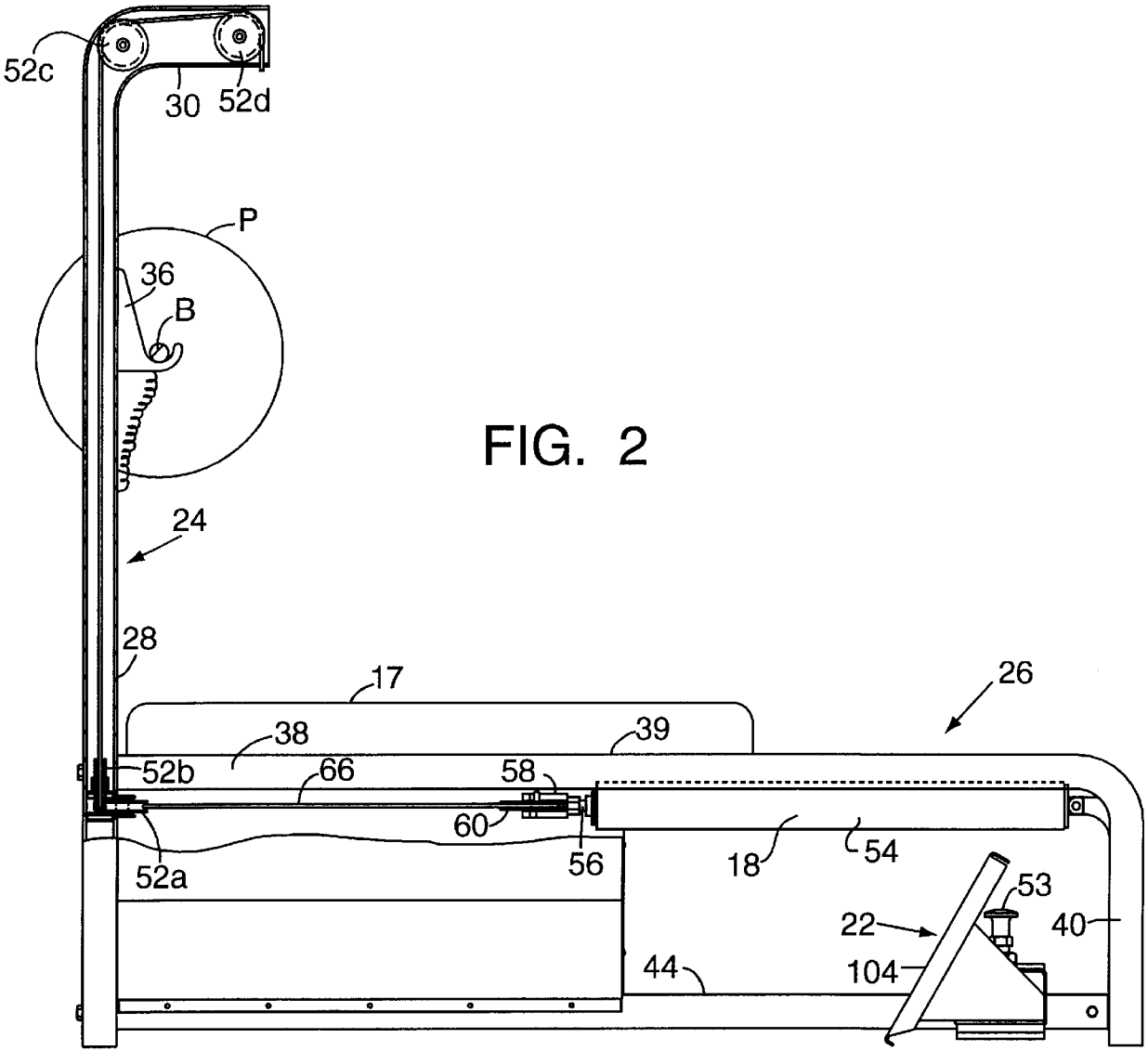
FIG. 2 is a somewhat enlarged fragmentary side elevational view of the machine of FIG. 1 shown with portions of the tubular frame broken away to reveal structure therein.

The illustrated machine 10 comprises a tubular frame assembly, indicated generally at 14, and a cable assembly, designated generally by the numeral 16, supported on the frame assembly for limited movement relative to the frame assembly and attached to the lifting bar B. The machine 10 further includes a bench 17 supported on the frame assembly 14 and a fluid motor or pneumatic cylinder 18 mounted on the frame assembly below the bench 17 (FIGS. 2 and 3) for operating the cable assembly 16 to apply lifting force to and otherwise control the barbell assembly 12 when and as necessary. A control system, indicated generally at 20 in FIG. 9, and hereinafter more fully described, includes a manually operated electrical controller or foot pedal assembly 22, shown in FIGS. 1–3, for controlling operation of a pneumatic portion of the control system 20 and which operates the pneumatic cylinder 18.

Considering now the machine 10 in further detail, the frame assembly 14 includes a cable suspension frame, indicated generally at 24, and a bench frame bolted or otherwise connected to the cable suspension frame and designated generally by the numeral 26. The cable suspension frame is formed by a pair of vertically upwardly extending cable suspension members of opposite hand indicated at 28, 28' and having rearwardly projecting cantilevered upper end portions 30, 30'. Horizontally disposed and transversely extending upper and lower connecting members, indicated at 32 and 34, respectively, join the cable suspension members 28, 28' in horizontally spaced apart relation to each other substantially as shown. The opposite ends of the tubular upper connecting member 32 open into and communicate with the interiors of the tubular cable suspension members 28 and 28', respectively, for a reason which will be hereinafter further evident. A pair of lifting bar supporting brackets 36, 36' are mounted on the rearwardly facing surfaces of the cable suspension members 28, 28', respectively, for receiving the lifting bar B of an associated barbell assembly, such as the barbell assembly 12, to support the barbell assembly in a generally axially horizontally disposed rest position, shown in FIG. 1.

Figure 3:
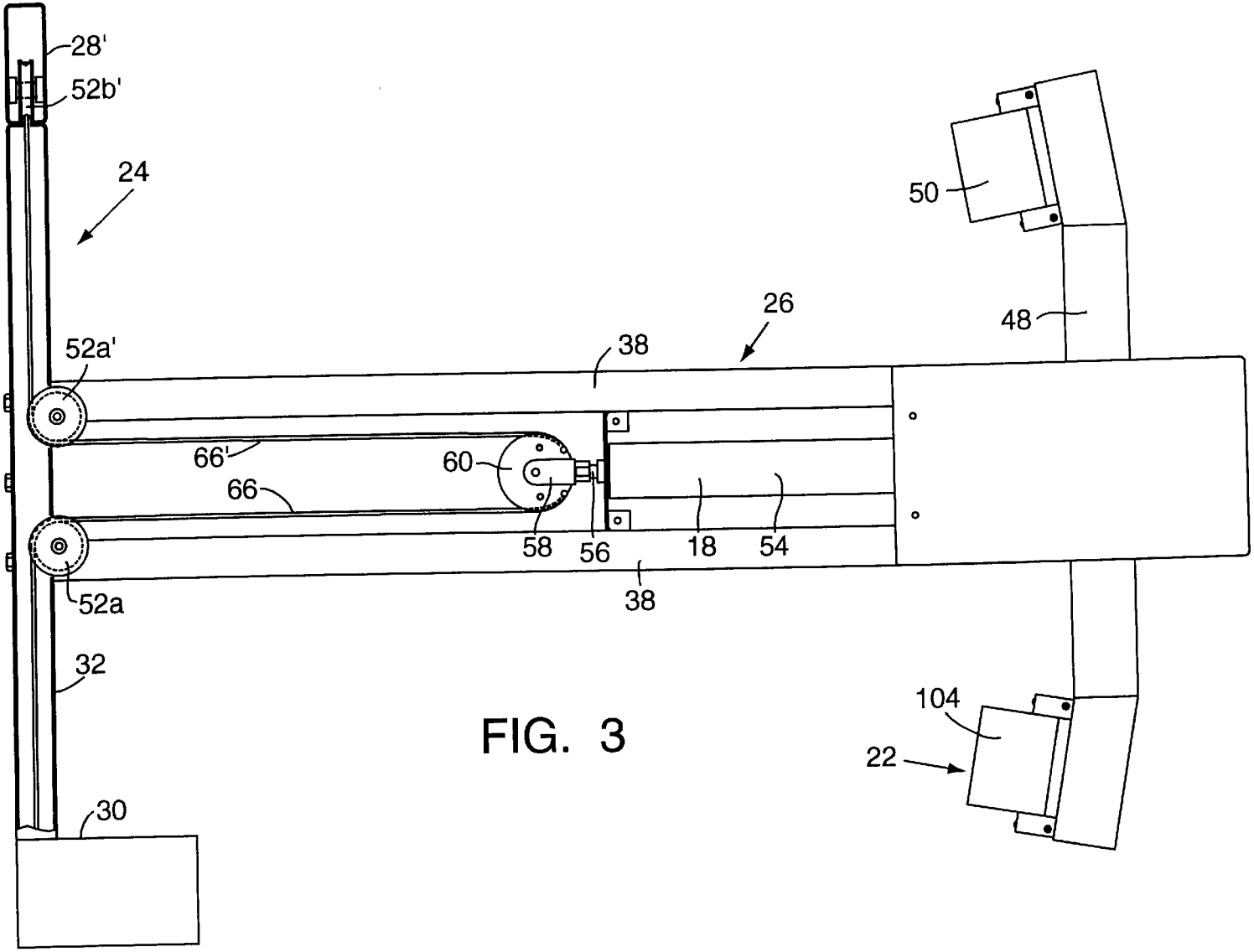
FIG. 3 is a somewhat further enlarged plan view of the machine shown with the bench removed and portions of the frame broken away.

The bench frame 26 is connected to the central portion of the cable suspension frame 24 and includes a pair of transversely spaced apart horizontally extending bench support members 38, 38 which define an upwardly facing bench supporting surface 39 (FIG. 2) upon which the bench 17 is mounted. The bench support members 38, 38 are bolted or otherwise attached to the upper connecting member 32 and extend in a longitudinally rearward direction from it. The rear end portions of the members 38, 38 are downwardly turned and form a pair of bench legs 40, 40 connected at the base by a transversely disposed cross member 42. The bench frame further includes an elongated longitudinally extending central base member 44 connected to and extending between the cross member 42 and the lower connecting member 34. A longitudinal series of upwardly open pin receiving apertures 46, 46 are formed in the base member 44. An adjustable base member 48 disposed transversely of the central base member 44 extends laterally outward in opposite directions from the central base member substantially as shown in FIG. 1. The adjustable base member 48 is supported to slide along the central base member 44 for longitudinal adjustment generally toward and away from the cable suspension frame 24. The foot pedal 22 is mounted on the right hand end of the adjustable base member 48, as viewed from the cable suspension frame looking toward the rear and as best shown in FIG. 3. A stationary foot rest 50 is mounted on the opposite or left hand end of the adjustable member 48. A locking pin mechanism 53 carried by the adjustable base member 48 is positioned within a selected one of the pin receiving apertures 46, 46 to lock the foot operated control pedal 22 and the foot rest 50 in a selected position of longitudinal adjustment relative to the cable suspension frame 26 to accommodate the particular physical requirements of a weightlifter using the machine.

For cosmetic as well as safety reasons portions of the cable assembly 16 are contained and supported within the tubular frame assembly 14. Support for the cable assembly is provided by a cable support system which includes a plurality of pairs of cable supporting pulleys or sheaves 52*a*–52*d*, 52*a*'–52*d*' journaled on and within the cable suspension frame 24, as will be hereinafter further discussed. Inspection plates (not shown) releasably secured to the frame members at the various pulley locations are removable to provide access to the cable supporting pulleys to facilitate routine maintenance and cable and/or pulley replacement, as may be necessary.

Figure 4:
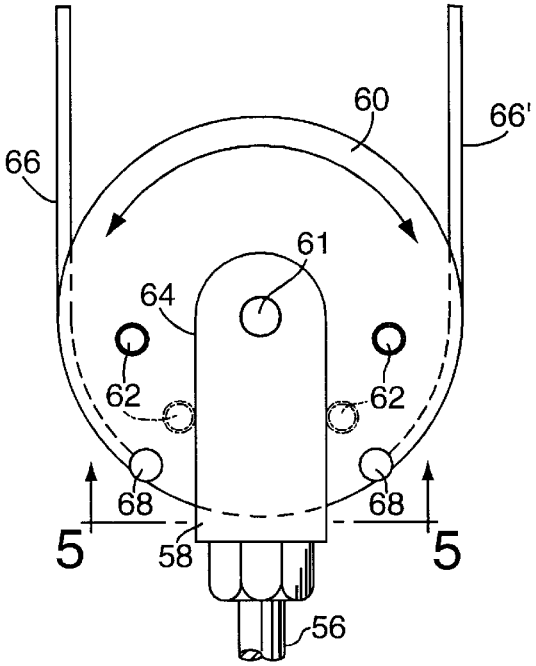
FIG. 4 is a somewhat further enlarged fragmentary plan view of the cable yoke and pulley connection.
Figure 5:
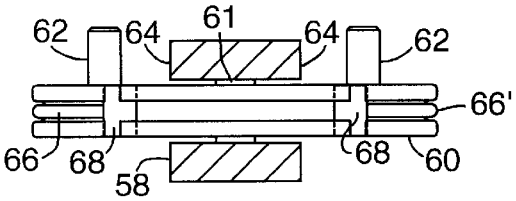
FIG. 5 is a fragmentary sectional view taken along the line 5—5 of FIG. 4.

A previously noted pneumatic cylinder 18 for operating the cable system 16 is mounted on the bench frame 26 below the bench supporting surface 39 and includes a fixed first part or cylinder 54 secured in fixed position at the rear of the bench frame and a moveable second part or piston rod 56 which projects forwardly from and is moveable relative to the cylinder 54 in a longitudinal direction generally toward and away from the frame upper connecting member 32. Operable connection between the cable assembly 16 and the pneumatic cylinder 18 is provided by a yoke 58 mounted at the forward or free end of the piston rod 56 and a pulley 60 supported by the yoke for limited angular movement relative to the yoke 58 and about a central axis defined by a pivot pin 61 which secures the pulley 60 to the yoke, as best shown in FIGS. 4 and 5. Specifically, a pair of arresting pins 62, 62 mounted in fixed position on the pulley 60 at opposite sides of the yoke cooperate with abutment surfaces 64, 64 defined by the yoke to arrest angular movement of the pulley 60 in either direction relative to the yoke.

The cable assembly 16 may comprise a single continuous length of cable having a central portion engaged with and secured in fixed position to the pulley 60. However, in accordance with the presently preferred construction of the machine 10 the cable assembly is formed by a pair of separate cable segments 66, 66'. Each cable segment has a ferrule 68 swedged onto or otherwise secured on one of its end portions to provide an enlargement for releasable engagement within an associated generally complimentary recess in the pulley 60 to secure the cable segment in fixed position to an associated peripheral portion of the pulley, as best shown in FIGS. 4 and 5. This cable connecting arrangement facilitates rapid cable removal and replacement, when necessary.

Figure 7:
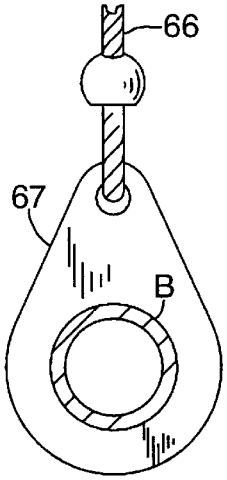
FIG. 7 is a somewhat enlarged fragmentary end elevational view of a cable attachment member shown attached to the lifting bar of an associated barbell assembly.
Figure 8:
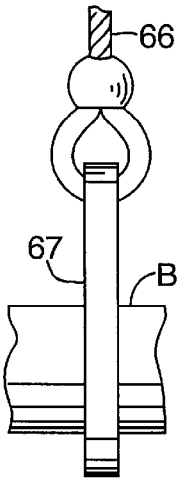
FIG. 8 is a fragmentary front elevational view of the attaching member and lifting bar shown in FIG. 7.
Figure 6:
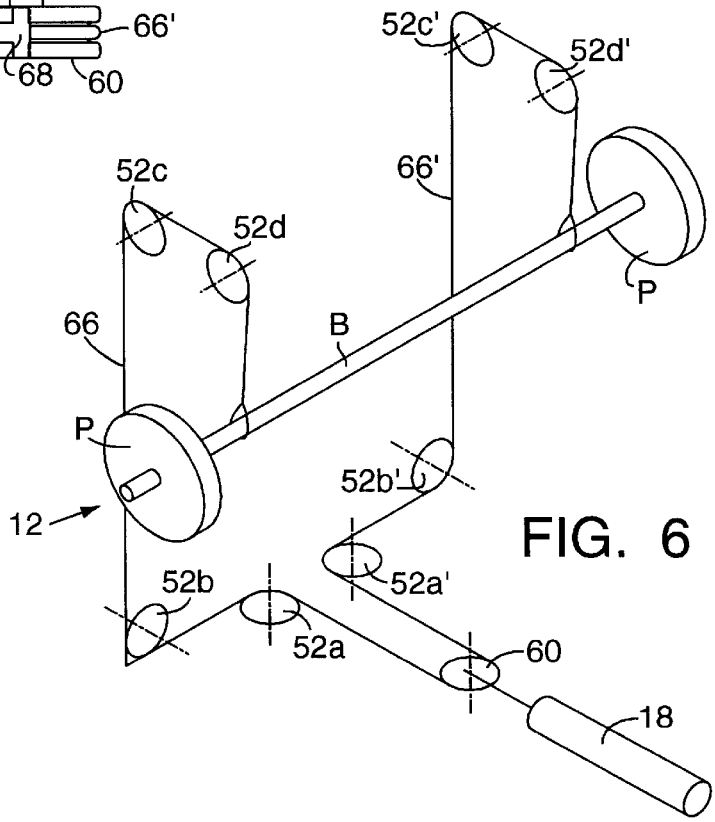
FIG. 6 is a schematic perspective view of the cable support system.

The cable segments 66, 66' enter the cable suspension frame through a central opening in the upper connecting member 32 and engage sheaves 52*a*, 52*a'* at opposite sides of the aforesaid central opening. The manner in which the cable segments 66, 66' are supported by the various sheaves within the cable suspension frame 24 is illustrated, somewhat schematically in FIG. 6. The free ends of the cable segments 66, 66' depend from the sheaves 52*d*, 52*d'* and are attached to the bar B of an associated barbell, such as the illustrated barbell 12, laterally outwardly beyond the hand grips G, G. In accordance with presently preferred practice, the cables are connected to the lifting bar B to prevent unauthorized removal of the lifting bar from the machine 10. This lifting bar connecting arrangement is particularly desirable where the machine is installed in a gymnasium or fitness center and used by many different weightlifters. FIGS. 7 and 8 show a lifting bar B secured to the end portion of a cable segment 66 by a typical attaching member indicated at 67. The cable assembly 16 normally supports the barbell assembly 12 with the lifting bar in an axially horizontal position. The arresting pins 62, 62 on the connecting pulley 60 cooperate with the yoke 58 to arrest angular movement of the pulley 60 and thereby limit the angular inclination of the lifting bar B relative to its normal horizontal position, 8 degrees to the horizontal being a preferred maximum angle of lifting bar inclination. The aforesaid cable arresting device assures that the weightlifter will not lose balance control of the barbell assembly. Further, it has been found that the plates P, P will usually not slide along the lifting bar when the bar inclination is 8 degrees or less. Thus the plates P, P will not tend to slide along the lifting bar to materially alter the balanced condition of the bar or fall from the lifting bar even if the weightlifter fails to secure the plates to the lifting bar with the collars C, C.

Figure 9:
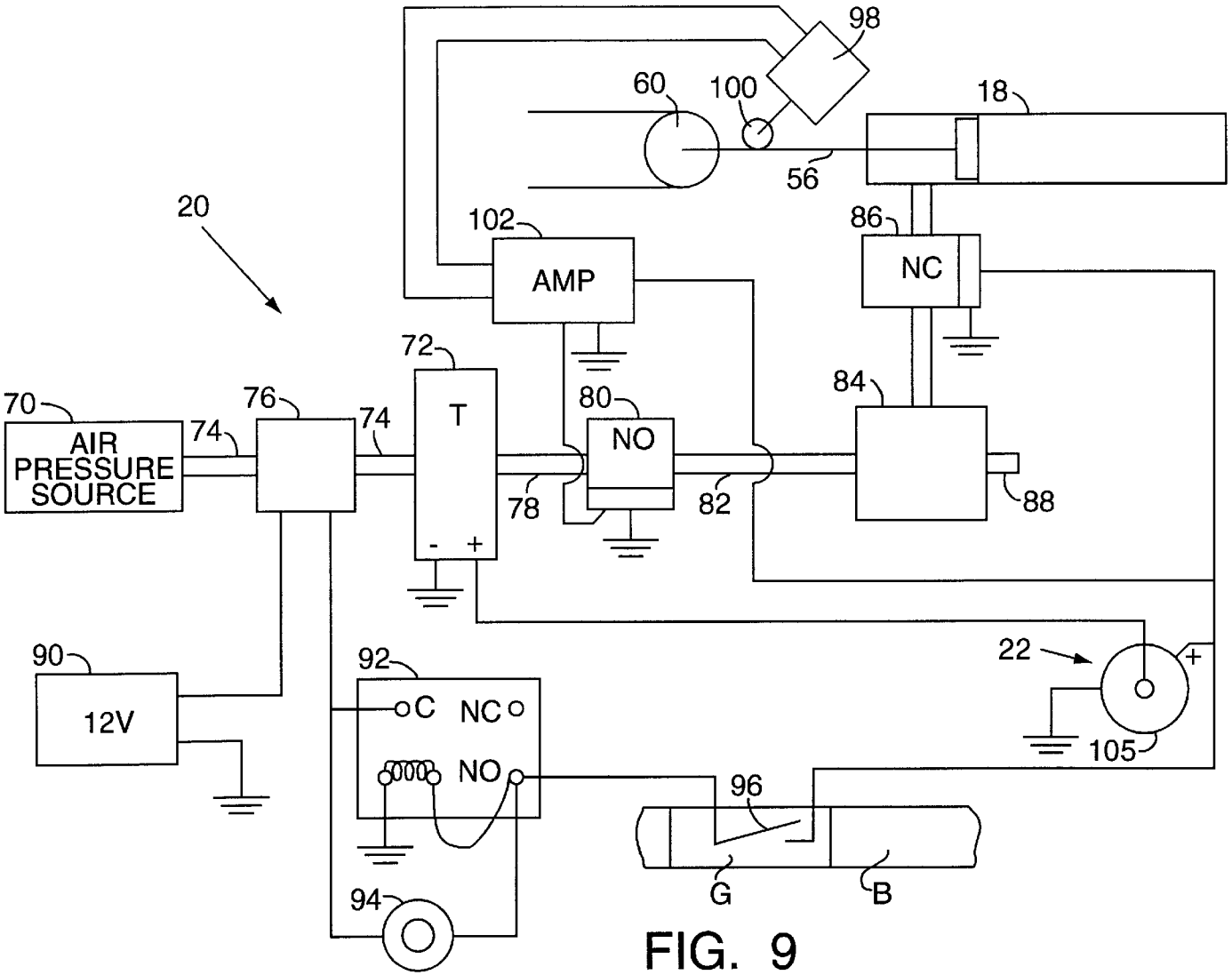
FIG. 9 is a diagrammatic illustration of the machine control system.

The control system 20 for operating the exercise machine 10, schematically illustrated in FIG. 9, essentially comprises an electropneumatic system for both controlling and regulating pressurized air supplied to the pneumatic motor 18 which operates the cable assembly 16 to selectively apply controlled lifting force to the barbell assembly 12. Further and in accordance with the invention, the control system includes a means for taking-up slack in the cable assembly 12 during the lifting mode of a normal barbell lifting exercise and for nullifying the effect of the slack take-up means during the barbell lowering mode to enable the exercise to be performed substantially free of machine influence. The control system 20 also incorporates fail-safe features which will be hereinafter discussed.

Referring now particularly to FIG. 9 and considering first the pneumatic operating portion of the control system 20, pressurized air for operating the pneumatic portion of the system is received from a pressurized air supply source indicated at 70, which may, for example, comprise an air compressor, air accumulator or other suitable air pressure supply source capable of delivering air at a pressure of about 125 psi. The system 20 includes an electropneumatic transducer 72 which has an air inlet port connected to the air supply source 70 by a conduit or air supply line 74. The transducer 72 preferably receives air from the air supply source 70 at a regulated pressure of about 90 psi. A normally open pressure sensitive switch 76 connected in the supply line 74 between the pressure source 70 and the transducer 72 monitors the pressure supplied to the inlet port of the transducer for a purpose to be hereinafter explained. The transducer 72 is adapted to supply air under pressure at an outlet port and at a pressure linearly proportional to a DC current or DC voltage input. The transducer 72 also includes a manually operable pressure regulator adjustable to deliver a continuous supply of air at the transducer outlet port and at a desired constant output pressure with no DC input. The presently preferred transducer is a Fairchild Model TT6000-46 Miniature Electropneumatic Transducer, produced by Fairchild Industrial Products Company, Winston-Salem, N.C.

The outlet port on the transducer 72 is connected by an air supply line 78 to the inlet port of a normally open solenoid operated control valve 80. An air supply line 82 connects the air outlet port of the control valve 80 to the air inlet port of a diaphragm operated exhaust valve of a well known type indicated at 84. The exhaust valve 84 has an air outlet port connected through a normally closed solenoid operated control valve 86 to the cylinder of the single action pneumatic cylinder or motor 18. The exhaust valve 84 also has an exhaust port 88 through which air under pressure may be exhausted from the motor 18 by operation of the valve 84 when the control system is in an operative state.

When the control system 20 is engergized and the pressure at the inlet side (transducer side) of the exhaust valve 84 is greater than the pressure at the outlet side (motor side) the exhaust port 88 is maintained in closed condition by the valve diaphragm and the inlet port is in communication with the outlet port of the exhaust valve 84 allowing pressurized air received from the transducer 72 to pass through the exhaust valve 84 and through the solenoid operated control valve 86, which is then open, and into the motor 18 to operate the motor thereby applying lifting force to the cable assembly. A reversal of the aforesaid pressure condition causes the flexible valve diaphragm to close the valve inlet port and place the valve outlet port of the exhaust valve in communication with the exhaust port 88 whereby pressurized air may be rapidly exhausted from the pneumatic motor 18 and through the exhaust port 88 to atmosphere. The presently preferred exhaust valve 78 is a Model EV20A2, Pneu-Trol Quick Exhaust Valve and may be obtained from Deltrol Fluid Products of Bellwood, Ill. However, other valves having similar operational characteristics may also be suitable for use in practicing the invention.

Power for operating the control system 20 is provided by a low voltage power source 90 connected through the normally open pressure sensing switch 76 to a conventional relay circuit 92 which includes a reset switch 94 the reset switch is preferably positioned in a remote location relative to the weightlifter's normal lifting position on the machine as, for example, a position below the bench 17. The electrically operated control pedal assembly 22 which performs the primary control function receives power from the relay circuit through a pressure sensitive normally open tape switch 96 located at one of the grips G on the barbell assembly 12. The normally closed solenoid operated control valve 86 also receives power from the output of the relay circuit through the tape switch 96.

The control system 20 further includes a motion sensing device for detecting movement of the cable assembly in a weight lowering direction. The presently preferred sensing device comprises a DC generator indicated generally at 98 and having a rotary follower 100 disposed in rolling engagement with the piston rod 56 for tracking movement of the piston rod. The generator 98 produces a signal output in response to movement of the piston rod 56 in only a forward direction corresponding to lowering movement of the barbell assembly 12. The signal output from the generator 98 is fed through a signal amplifier 102 which is electrically connected to the normally open solenoid valve 80 and which provides the electrical power to close the latter valve, for a purpose which will be hereinafter further evident.

Preparatory to operating the machine 10, the manually adjustable pressure regulator on the electropneumatic transducer 72 is adjusted to deliver a continuous supply of air under pressure at a regulated pressure of about 5 psi even when there is no electrical input to the transducer. The pressure sensitive switch 76 is preferably regulated so that the normally open electrical contacts within the switch will close and remain closed in response to a pressure of at least 90 psi in the supply line 74.

When a weightlifter assumes a normal lifting position on the bench 17 and grasps the lifting bar grips G, G the normally open tape switch 96 will close thereby energizing the remainder of the control system 20 including the normally closed solenoid valve 86 which then moves to open position. Since the pressure (5 psi) in the supply line 82 on the transducer side of the quick exhaust valve 84 is greater than the pressure on the pneumatic motor side of the exhaust valve the diaphragm within the exhaust valve 84 will take a position which places the exhaust valve inlet port in communication with the exhaust valve outlet port so that air at a pressure of 5 psi is supplied to the pneumatic motor 18. It has been found that a pressure of about 5 psi will enable the air motor 18 to supply sufficient lifting force to the cable assembly to overcome the weight of the depending cable segments connected to the barbell assembly 12 and friction within the cable pulley support system to remove slack from the cable assembly as the barbell 12 is lifted during a normal exercise routine and without applying significant lifting force to the lifting bar B.

The control system 20 is further arranged to nullify the slack removing force applied to the cable assembly 16 when the barbell 12 is being lowered during a normal weightlifting exercise. The generator 98 which senses the lowering movement of the piston rod 56 provides an output signal to the signal amplifier 102 which, in turn, energizes the normally open solenoid valve 80 causing the valve to move to closed position cutting off the supply of low pressure air (5 psi) to the quick exhaust valve 84. The pressure at the pneumatic motor side of the exhaust valve 84 is now greater than the pressure on the transducer side which causes the diaphragm within the exhaust valve 84 to shift to a position wherein the outlet port of the exhaust valve is in communication with the exhaust port 88 which allows for rapid exhaust of pressurized air from the motor 18. Thus the slack removing force applied to the barbell 12 during the lifting mode is nullified during the lowering mode so that a weightlifter may perform a freeweight lifting exercise substantially free of any machine influence.

During its exhaust cycle the single action pneumatic motor 18 functions as a cable assembly damping device to prevent development of slack in the depending cable segments when the barbell is allowed to move in the lowering direction by a weightlifter using the machine. The weight of the depending end portions of the depending end portions of the cable assembly acts upon the piston rod 56 causing the piston rod to move in its lowering direction thereby damping and controlling the movement of the cable assembly during lowering movement of the barbell. Thus, the cable assembly is maintained in a substantially slack-free condition at all times and without exerting significant influence upon movement of the barbell.

If and when the weightlifter requires lifting assistance during a freeweight lifting exercise such lifting assistance as may be required will be provided by the machine under the control of the weightlifter and in response to operation of the foot pedal assembly 22.

The primary control function of applying lifting force to the barbell 12 and varying the applied lifting force is provided by the manually operated foot pedal assembly 22 which controls the variable air pressure output from the outlet port of the transducer 72. The foot pedal assembly 22 includes a foot pedal 104 shown in FIGS. 1–3 and an associated rotary audio taper potentiometer 105, illustrated schematically in FIG. 9, which provides a generally exponential output in response to a generally linear input. The potentiometer 105 is supported for rotary movement in response to pivotal movement of the foot pedal 104 through an angle of approximately 45° for zero to maximum output corresponding to toe up and toe down positions of the pedal. The variable resistance of the potentiometer is electrically coupled to the low voltage DC power source (12 v) 90 which provides sufficient DC voltage and current to satisfy the requirements of the transducer 72. The electrical resistance of the potentiometer 105 is maximum at 0 current input and decreases generally exponentially in response to pivotal operation of the foot pedal 104. A reduction of about 10% in the electrical resistance of the potentiometer occurs during the first 50% of foot pedal movement. A CLAROSTAT 485 C1 2500 Ω Z is presently preferred.

Figure 10:
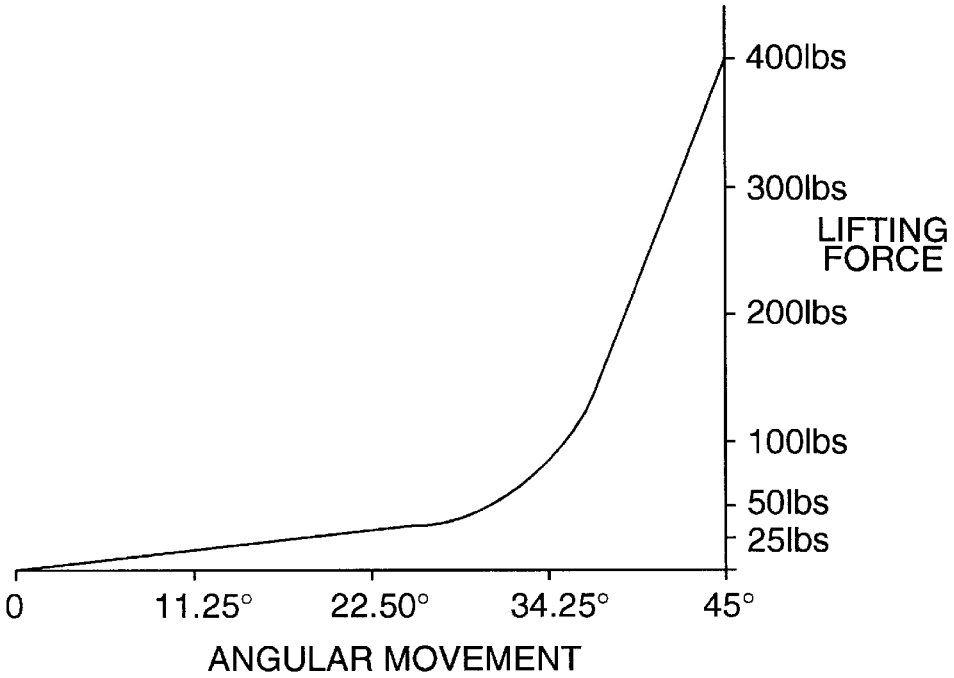
FIG. 10 is a graphic illustration showing the relationship between foot pedal movement and lifting force output.

During approximately the first 22 ½° of angular movement of the foot pedal 104 pressurized air fed to the pneumatic motor cylinder 54 produces a lifting force ranging from 0 to about 20 lbs and acting upwardly upon the barbell 12. During the remaining pivotal movement of the pedal from its 22 ½° to its 45° position the applied lifting force increases sharply from about 20 lbs. to about 400 lbs. This condition is illustrated graphically in FIG. 10 where angular movement of the foot pedal 104 is plotted against applied lifting force. Thus, control system 20 is sensitive to initial movement, allowing the weightlifter to gradually supplement his or her lifting energy with lifting force applied by the machine, as desired. However, should the weightlifter suddenly require substantial lifting assistance, that assistance will be provided by the machine, as called for by the weightlifter, in response to increased angular movement of the foot pedal 104.

Since the cable assembly is maintained in a substantially slack-free condition at all times, response to operation of the control pedal will be substantially instantaneous. Reverse movement of the pedal 104 exhausts pressurized air from the pneumatic motor 18 and allows the weightlifter to resume a freeweight lifting exercise free of machine influence when the pedal is not in use.

In the event that the air pressure within the supply line 74 should fall below the predetermined pressure (90 psi) required to properly operate the control system 20 the pressure switch 76 will sense this pressure drop and return to its normally open circuit condition thereby interrupting electrical power to the relay circuit 92 and disabling the control system 20. Upon loss of electrical power the solenoid control valve 86 will return to its normally closed condition, thereby trapping air under pressure within the pneumatic motor 18. If such a pressure drop should occur while the weightlifter is operating the foot pedal to apply significant lifting force to the barbell 12 the pressure of the air trapped within the pneumatic motor 18 may be sufficient to retain the barbell 12 in its attained position at the time that the pressure drop or electrical power failure occurred.

If a loss of pressure at the source 70 or an electrical outage should occur while the barbell 12 is being lifted during a normal lifting exercise air at low pressure (5 psi) will be trapped within the pneumatic motor 18 by closure of the solenoid valve 86. However, even such low pressure air trapped within the motor will serve as an air cushion to prevent the cable assembly 16 from being subjected to a snap load which could result in cable fatigue or breakage.

When electrical power to the control system 20 has been interrupted the reset switch 94 associated with the relay circuit 92 must be operated to restore power to the control system 20. This arrangement assures that the machine will not suddenly and unexpectedly apply lifting force to the barbell 12 upon restoration of air pressure or electrical power.

Figure 15:
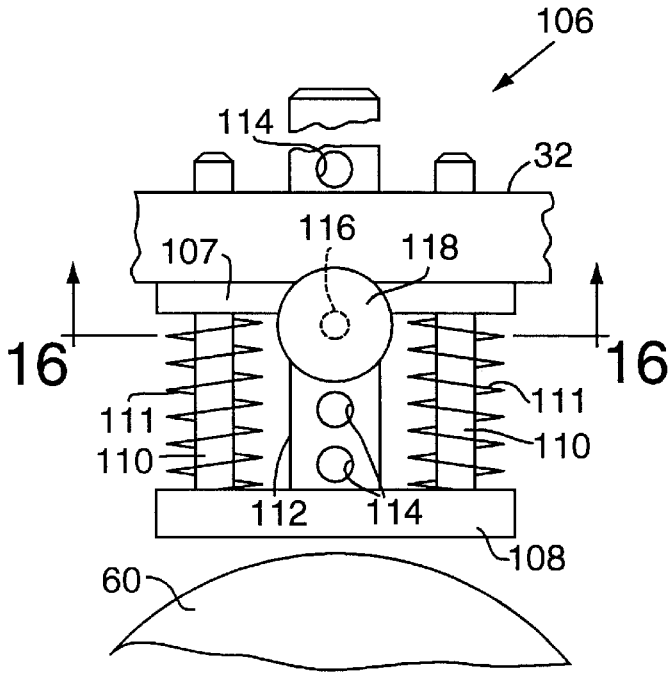
FIG. 15 is a fragmentary plan view and shows an optional adjustable cable arresting device for use with the machine.
Figure 16:
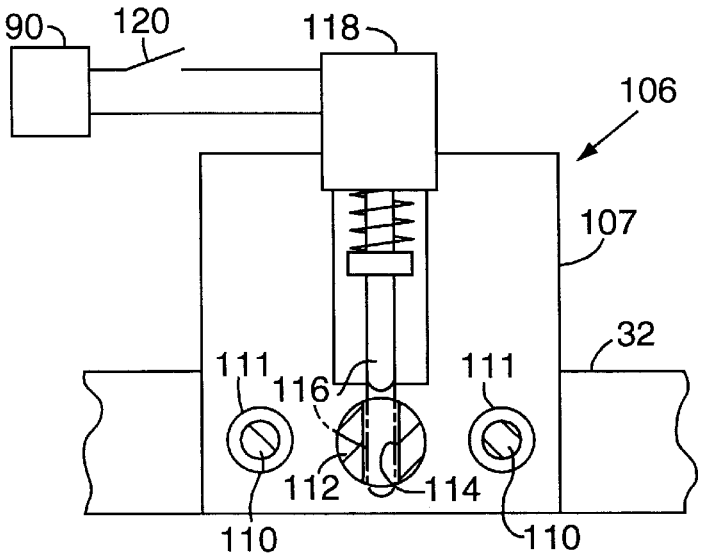
FIG. 16 is a sectional view taken alosng the line 16—16 of FIG. 15.

The machine 10 may also include an adjustable cable arresting device for arresting movement of the pulley 60 in the direction of the cable suspension frame 24 to limit lowering movement of the cable segments 66, 66'. The cable arresting device, indicated generally at 106 in FIGS. 15 and 16, is supported on a mounting plate 107 mounted on the front surface of the upper connecting member 32 and in the path of the pulley 60 and includes an arresting member 108 disposed in generally parallel relation to the connecting member 32. A pair of transversely spaced apart guide rods 110, 110 which carry springs 111, 111 extend rearwardly from the arresting member 108 and through associated apertures in the mounting plate 107 and in the connecting member 32. A cylindrical locking rod 112 projects rearwardly from the arresting member 108 between the guide rods 110, 110 in parallel relation to the guide rods and extends through openings in the mounting plate and in the tubular connecting member 32, substantially as shown. The locking rod 112 has a series of spaced apart locking apertures 114, 114 which extend diametrically through it for receiving a locking pin 116 driven by an associated solenoid 118 supported on the mounting plate. The locking pin 116 is normally disposed within one of the locking apertures 114 and is withdrawn from the locking rod 112 against an opposing spring biasing force by operating the solenoid 118 which is actuated by an operating switch 120, preferably located on the frame of the machine 10 within reach of a weightlifter in lifting position on the bench 17.

The device may be adjusted by the weightlifter by operating the switch 120 to withdraw the locking pin 116 from the locking rod 112, lowering the lifting bar to the lowermost desired position and holding it in the desired position of adjustment by operating the foot pedal. Lowering the barbell assembly causes the pulley 60 to move toward and into engagement with the arresting member 108 urging the arresting member toward the frame member 32. When the lifting bar has attained the lowermost position desired by the weightlifter the solenoid switch is released allowing the locking pin 116 to drop into the nearest available locking aperture 114. The lowermost limit of barbell assembly movement is now established.

Figure 11:
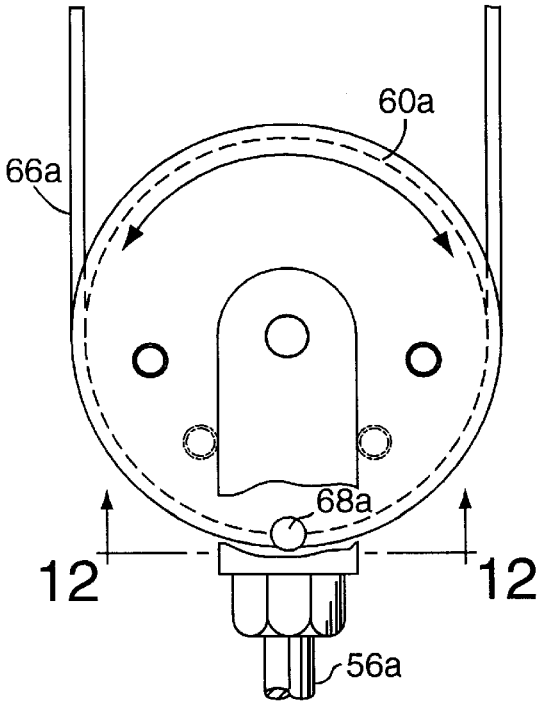
FIG. 11 is similar to FIG. 4 but shows another arrangement of the cable and pulley connection.
Figure 12:
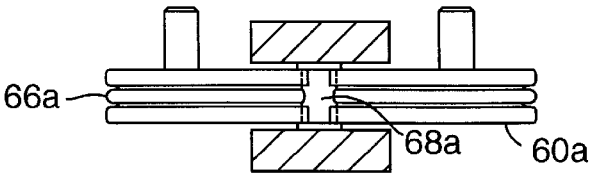
FIG. 12 is a sectional view taken along the line 12—12 of FIG. 11.

As previously noted the invention may be practiced with a cable assembly which includes a single length of cable. Such an arrangement is illustrated in FIGS. 11 and 12 wherein the cable is indicated by the numeral **66*a*. The cable 66*a* has a single ferrule 68*a* staked or otherwise firmly fixed to it at its midpoint. The ferrule 68*a* is received within a generally complimentary recess in a pulley 60*a***, substantially as shown, whereby the cable is secured in fixed position relative to the pulley for limited movement with the pulley.

Figure 13:
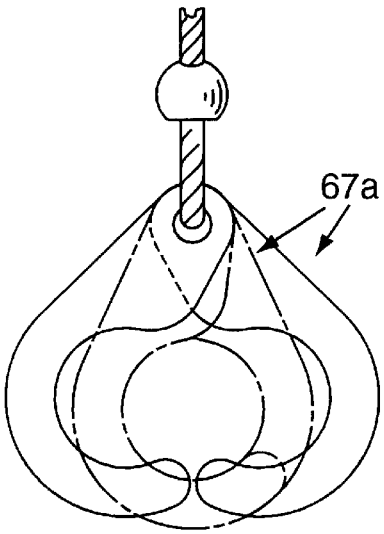
FIG. 13 is similar to FIG. 7 but illustrates another cable attachment member.
Figure 14:
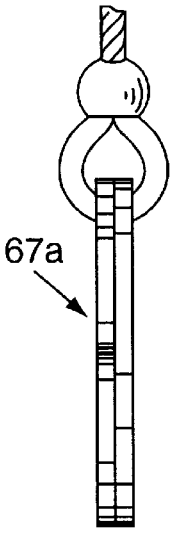
FIG. 14 is a front elevational view of the attachment member shown in FIG. 13.

There are situations where it may be desirable to remove the barbell assembly from the machine upon completion of an exercise program as, for example, where the machine is adapted for home use by a single weightlifter. For this purpose an attaching member is provided for releasably securing a lifting bar to an associated cable end portion. Such a releasable attaching member is shown in FIGS. 13 and 14 and indicated generally by the numeral **67*a*. A suitable releasable plugging electrical connector (not shown) will also be provided for releasable connecting the tape switch 96 on the barbell lifting bar to the control system 20**.

I claim:

1. A freeweight exercise machine for use with a barbell having an axially elongated lifting bar and a plurality of weights carried by the bar, said machine comprising a frame assembly including a cable suspension frame having a pair of transversely spaced apart and upwardly extending cable suspension members each having a generally rearwardly extending cantilever upper end portion, and a bench support frame connected to a central portion of said cable suspension frame and extending longitudinally rearwardly therefrom, said bench support frame defining a generally horizontally disposed and upwardly facing bench support surface, a cable assembly having opposite end portions, cable supporting means for mounting said cable assembly on said cable suspension frame for movement relative to said cable suspension frame with each of said opposite end portions depending from an associated one of said cantilever upper end portions, attaching means for securing said opposite end portions to the lifting bar of an associated barbell assembly in axially spaced apart relation to each other to support the barbell assembly with the lifting bar in a generally axially horizontal position, a fluid motor mounted on said bench support frame below said bench support surface, said fluid motor having a first part secured in fixed position relative to said bench frame and a second part supported for reciprocal movement relative to said first part and generally toward and away from said cable suspension frame, connecting means for attaching said cable assembly to said motor for movement with and relative to said second part and including a yoke carried by said second part, a pulley supported for rotation on and relative to said yoke, and anchoring means securing a portion of said cable assembly in fixed position to said pulley, arresting means independent of said frame assembly for limiting the angle of inclination of said lifting bar relative to said horizontal position including a pair of limit stops mounted on said pulley and engageable with said yoke to limit the angular movement of said pulley relative to said yoke, and a control system for controlling the operation of said machine and including manually operable motor control means for operating said motor to apply lifting force to the barbell assembly and to vary the magnitude of said lifting force.

2. A freeweight exercise machine as set forth in claim 1 wherein said cable suspension frame comprises a tubular frame, said cable supporting means comprises a plurality of sheaves journaled for rotation within said tubular frame, and a portion of said cable assembly is disposed within said tubular frame and engaged with said sheaves.

3. A freeweight exercise machine as set forth in claim 1 wherein said cable assembly includes a pair of cable segments, each of said segments defines an associated one of said opposite end portions and has another end portion, and said anchoring means is further characterized as means for releasably securing said another end portion of each of said segments in fixed position to said pulley.

4. A freeweight exercise machine as set forth in claim 1 wherein said cable assembly includes a central portion disposed midway between said opposite end portions and said anchoring means comprises means for releasably securing said central portion in fixed position to a peripheral portion of said pulley.

5. A freeweight exercise machine as set forth in claim 1 wherein said manually operable motor control means comprises a manually movable controller for applying to the barbell assembly a lifting force which increases generally exponentially in response to linear movement of said controller.

6. A freeweight exercise machine as set forth in claim 1 wherein said fluid motor is further characterized as a pneumatic motor and said control system includes means for connecting said motor to a pressurized air source for operating said motor and pressure sensing means for disabling said control system when the pressure of the air supplied by said pressurized air source is below a predetermined magnitude.

7. A freeweight exercise machine as set forth in claim 1 including adjustable arresting means for limiting movement of said second part in the direction of said cable suspension frame.

8. A freeweight exercise machine as set forth in claim 1 wherein said control system comprises an electrically powered system and includes means for trapping pressure fluid in said fluid motor when said control system is disabled by the loss of electrical power to said control system.

9. A freeweight exercise machine for use with a barbell including an axially elongated lifting bar and a plurality of weights carried by said lifting bar, said machine comprising a frame assembly, a cable assembly having spaced apart opposite end portions, cable supporting means for mounting said cable assembly on said frame for movement relative to the frame with said opposite end portions depending from the frame, attaching means for securing said opposite end portions in axially spaced apart relation to the lifting bar of an associated barbell, a motor having a first part mounted in substantially fixed position relative to the frame and a second part supported for movement relative to the first part, connecting means for attaching said cable assembly to said second part, and a control system for controlling the operation of the machine and including a manually operable motor controller for operating said motor and applying to the associated barbell a lifting force which increases generally exponentially in response to linear input to said controller, slack take-up means for removing slack from said cable assembly in response to manual lifting force applied to the associated barbell by a weightlifter using the machine, and nullifying means for disabling said slack take-up means while the associated barbell is being lowered by a weightlifter using the machine.

10. A freeweight exercise machine as set forth in claim 9 wherein said control system includes grip sensing means for enabling operating of said control system in response to gripping a force of predetermined magnitude applied to a gripping portion of the lifting bar and for disabling said control system in the absence of said gripping force.

11. A freeweight exercise machine as set forth in claim 10 wherein said motor is further characterized as pneumatic motor and said control system include means for connecting said motor to a source of air under pressure for operating said motor and pressure sensing means for disabling said control system when the pressure at said source of air under pressure is below a predetermined magnitude.

12. A freeweight exercise machine for use with a barbell having an axially elongated lifting bar and a plurality of weights carried by the bar, said machine comprising a frame assembly including a cable suspension frame having a pair of transversely spaced apart and upwardly extending cable suspension members each having a generally rearwardly extending cantilever upper end portion, and a bench support frame connected to a central portion of said cable suspension frame and extending longitudinally rearwardly therefrom, said bench support frame defining a generally horizontally disposed and upwardly facing bench support surface, a cable assembly having opposite end portions, cable supporting means for mounting said cable assembly on said cable suspension frame for movement relative to said cable suspension frame with each of said opposite end portions depending from an associated one of said cantilever upper end portions, attaching means for securing said opposite end portions to the lifting bar of an associated barbell in axially spaced apart relation to each other to support the barbell with the lifting bar in a generally axially horizontal position, a fluid motor mounted on said bench support frame below said bench support surface, said fluid motor having a first part secured in fixed position relative to said bench frame and a second part supported for reciprocal movement relative to said first part and generally toward and away from said cable suspension frame, connecting means for attaching said cable assembly to said motor for movement with and relative to said second part, and a control system for controlling the operation of said machine and including manually operable motor control means for operating said motor to apply lifting force to the barbell and to vary the magnitude of said lifting force, and slack take-up means for removing slack from said cable assembly in response to manual lifting force applied to the barbell assembly by a weightlifter using said machine, said slack take-up means including means for operating said fluid motor independently of said manually operated motor control means to apply slack removing force to said cable assembly.

13. A freeweight exercise machine as set forth in claim 12 wherein said control system includes nullifying means for disabling said slack take-up means while the barbell assembly is being lowered by a weightlifter using the machine.

14. A freeweight exercise machine as set forth in claim 13 wherein said nullifying means comprises motion sensing means responsive to the movement of said second part in a direction away from said cable suspension frame.

15. A freeweight exercise machine for use with a barbell having an axially elongated lifting bar and a plurality of weights carried by the bar, said machine comprising a frame assembly including a cable suspension frame having a pair of transversely spaced apart and upwardly extending cable suspension members each having a generally rearwardly extending cantilever upper end portion, and a bench support frame connected to a central portion of said cable suspension frame and extending longitudinally rearwardly therefrom, said bench support frame defining a generally horizontally disposed and upwardly facing bench support surface, a cable assembly having opposite end portions, cable supporting means for mounting said cable assembly on said cable suspension frame for movement relative to said cable suspension frame with each of said opposite end portions depending from an associated one of said cantilever upper end portions, attaching means for securing said opposite end portions to the lifting bar of an associated barbell in axially spaced apart relation to each other to support the barbell with the lifting bar in a generally axially horizontal position, a fluid motor mounted on said bench support frame below said bench support surface, said fluid motor having a first part secured in fixed position relative to said bench frame and a second part supported for reciprocal movement relative to said first part and generally toward and away from said cable suspension frame, connecting means for attaching said cable assembly to said motor for movement with and relative to said second part, and a control system for controlling the operation of said machine and including manually operable motor control means for operating said motor to apply to the barbell a lifting force which increases generally exponentially in response to linear movement of said controller and to vary the magnitude of said lifting force.

16. A freeweight exercise machine as set forth in claim 15 wherein said control system is normally disabled and includes grip sensing means for enabling operating of said control system in response to an enabling force applied to the lifting bar at a gripping position of the bar.

17. A freeweight exercise machine as set forth in claim 16 wherein said grip sensing means comprises a normally open electrical switch mounted on said lifting bar and electrically connected between said control system and a source of electrical power for operating said system.

18. A freeweight exercise machine as set forth in claim 15 wherein said controller comprises a foot pedal.

19. A freeweight exercise machine as set forth in claim 15 wherein said controller includes and audio taper potentiometer.

20. A freeweight exercise machine for use with a barbell having an axially elongated lifting bar and a plurality of weights carried by the bar, said machine comprising a frame assembly including a cable suspension frame having a pair of transversely spaced apart and upwardly extending cable suspension members each having a generally rearwardly extending cantilever upper end portion, and a bench support frame connected to a central portion of said cable suspension frame and extending longitudinally rearwardly therefrom, said bench support frame defining a generally horizontally disposed and upwardly facing bench support surface, a cable assembly having opposite end portions, cable supporting means for mounting said cable assembly on said cable suspension frame for movement relative to said cable suspension frame with each of said opposite end portions depending from an associated one of said cantilever upper end portions, attaching means for securing said opposite end portions to the lifting bar of an associated barbell in axially spaced apart relation to each other to support the barbell with the lifting bar in a generally axially horizontal position, a pneumatic motor mounted on said bench support frame below said bench support surface and connected to a pressurized air source for operating said pneumatic motor, said pneumatic motor having a first part secured in fixed position relative to said bench frame and a second part supported for reciprocal movement relative to said first part and generally toward and away from said cable suspension frame, connecting means for attaching said cable assembly to said motor for movement with and relative to said second part, and a control system for controlling the operation of said machine and including manually operable motor control means for operating said motor to apply lifting force to the barbell and to vary the magnitude of said lifting force and pressure sensing means for disabling said control system when the pressure of the air supplied by said pressurized air source is below a predetermined magnitude.

21. A freeweight exercise machine as set forth in claim 20 wherein said control system includes manually operable reset means for restoring said control system to an operable state after the control system has been disabled in response to operation of said pressure sensing means.

22. A freeweight exercise machine as set forth in claim 20 wherein said control means includes means for trapping air under pressure in said pneumatic motor when said control system is disabled in response to operation of said pressure sensing means.

23. A freeweight exercise machine for use with a barbell having an axially elongated lifting bar and a plurality of weights carried by the bar, said machine comprising a frame assembly including a cable suspension frame having a pair of transversely spaced apart and upwardly extending cable suspension members each having a generally rearwardly extending cantilever upper end portion, and a bench support frame connected to a central portion of said cable suspension frame and extending longitudinally rearwardly therefrom, said bench support frame defining a generally horizontally disposed and upwardly facing bench support surface, a cable assembly having opposite end portions, cable supporting means for mounting said cable assembly on said cable suspension frame for movement relative to said cable suspension frame with each of said opposite end portions depending from an associated one of said cantilever upper end portions, attaching means for securing said opposite end portions to the lifting bar of an associated barbell in axially spaced apart relation to each other to support the barbell with the lifting bar in a generally axially horizontal position, a fluid motor mounted on said bench support frame below said bench support surface, said fluid motor having a first part secured in fixed position relative to said bench frame and a second part supported for reciprocal movement relative to said first part and generally toward and away from said cable suspension frame, adjustable arresting means for limiting movement of said second part in the direction of said cable suspension frame, connecting means for attaching said cable assembly to said motor for movement with and relative to said second part, and a control system for controlling the operation of said machine and including manually operable motor control means for operating said motor to apply lifting force to the barbell and to vary the magnitude of said lifting force.

24. A freeweight exercise machine for use with a barbell including an axially elongated lifting bar and a plurality of weights carried by said lifting bar, said machine comprising a frame, a cable assembly having opposite end portions, cable supporting means for mounting said cable assembly on said frame for movement relative to the frame with said opposite end portions depending from the frame in spaced apart relation to each other, attaching means for securing said opposite end portions in axially spaced apart relation to the lifting bar of an associated barbell, a motor having a first part mounted in substantially fixed position relative to the frame and a second part supported for movement relative to the first part, connecting means for attaching said cable assembly to said second part and including a yoke carried by said second part, a pulley supported for rotation on and relative to said yoke, anchoring means for securing a portion of said cable assembly to said pulley, and arresting means including a pair of limit stops mounted on said pulley and engageable with said yoke for limiting angular movement of said pulley relative to said yoke, and a control system for controlling the operation of the machine and including a manually operable motor controller for operating said motor to apply lifting force to an associated barbell attached to said cable assembly and to vary the magnitude of the applied lifting force.

25. A freeweight exercise machine for use with a barbell including an axially elongated lifting bar and a plurality of weights carried by said lifting bar, said machine comprising a frame, a cable assembly having opposite end portions, cable supporting means for mounting said cable assembly on said frame for movement relative to the frame with said opposite end portions depending from the frame in spaced apart relation to each other, attaching means for securing said opposite end portions in axially spaced apart relation to the lifting bar of an associated barbell, a motor having a first part mounted in substantially fixed position relative to the frame and a second part supported for movement relative to the first part, connecting means for attaching said cable assembly to said second part and including a yoke carried by said second part and a pulley supported for rotation on said yoke, said cable assembly being releasably secured in fixed position to a peripheral portion of said pulley.

26. A free weight exercise machine as set forth in claim 25 wherein said cable assembly includes a pair of cable segments and each of said cable segments defines an associated one of said opposite end portions and has another end portion releasably secured in fixed position to said pulley.

27. A freeweight exercise machine for use with a barbell including an axially elongated lifting bar and a plurality of weights carried by said lifting bar, said machine comprising a frame, a cable assembly having spaced apart opposite end portions, cable supporting means for mounting said cable assembly on said frame for movement relative to the frame with said opposite end portions depending from the frame, attaching means for securing said opposite end portions in axially spaced apart relation to the lifting bar of an associated barbell, a motor having a first part mounted in substantially fixed position relative to the frame and a second part supported for movement relative to the first part, connecting means for attaching said cable assembly to said second part, and a control system for controlling the operation of said machine and including manually operable motor control means for operating said motor to apply lifting force to the associated barbell attached to said cable assembly and to vary the magnitude of the applied lifting force, and slack take-up means for removing slack from said cable assembly in response to manual lifting force applied to the barbell by a weightlifter using the machine and including means for operating said motor independently of said manually operated motor control means.

28. A freeweight exercise machine as set forth in claim 27 wherein said control system includes nullifying means for disabling said slack take-up means while the barbell is being lowered by a weightlifter using the machine.

29. A freeweight exercise machine as set forth in claim 27 including damping means for preventing development of slack in said cable asembly when a weightlifter using said machine allows the barbell to move in a lowering direction.

30. A freeweight exerrcixe machine as set forth in claim 29 wherein said damping means comprises said motor.

31. A freeweight exercise machine as set forth in claim 30 wherein said motor is further characterized as a pneumatic motor, said machine inlcludes means for connecting said motor to a pressurized air source for operating said motor, and said damping means comprises means for exhausting pressurized air from said motor when a weightlifter using said machine allows the barbell to move in the lowering direction.

32. A freeweight exercise machine for use with a barbell including an axially elongated lifting bar and a plurality of weights carried by said lifting bar, said machine comprising a frame, a cable assembly having spaced apart opposite end portions, cable supporting means for mounting said cable assembly on said frame for movement relative to said frame with said opposite end portions depending from said frame, attaching means for securing said opposite end portions in axially spaced apart relation to the lifting bar of an associated barbell, a motor having a first part mounted in substantially fixed position relative to said frame and a second part supported for movement relative to said first part, connecting means for attaching said cable assembly to said second part, and a control system for controlling the operation of said machine and including a manually operable motor controller for operating said motor and applying to the associated barbell a lifting force which increases generally exponentially in response to linear input to said controller.

33. A freeweight exercise machine as set forth in claim 32 wherein said motor controller includes an audio taper potentiometer.

34. A freeweight exercise machine for use with a barbell including an axially elongated lifting bar and a plurality of weights carried by said lifting bar, said machine comprising a frame, a cable assembly having spaced apart opposite end portions, cable supporting means for mounting said cable assembly on said frame for movement relative to said frame with said opposite end portions depending from said frame, attaching means for securing said opposite end portions in axially spaced apart relation to the lifting bar of an associated barbell, a pneumatic motor, means for connecting said motor to a pressurized air source for operating said motor, said motor having a first part mounted in substantially fixed position relative to the frame and a second part supported for movement relative to the first part, connecting means for attaching said cable assembly to said second part, and a control system for controlling the operation of the machine and including a manually operable motor controller for operating said motor to apply a lifting force to an associated barbell attached to said cable assembly and pressure sensing means for disabling said control system when the pressure of the air supplied by said pressurized air source is below a predetermined magnitude.

35. A freeweight exercise machine as set forth in claim 34 wherein said control system includes manually operable reset means for restoring said control system to an operable state after said control system has been disabled in response to operation of said pressure sensing means.

* * * * *